US006301943B1

(12) United States Patent
McGuire et al.

(10) Patent No.: US 6,301,943 B1
(45) Date of Patent: Oct. 16, 2001

(54) METHOD FOR FINISHING COLD-ROLLED STAINLESS STEEL

(75) Inventors: Michael F. McGuire, Pittsburgh, PA (US); Richard W. McCabe, Stark, OH (US)

(73) Assignee: J&L Specialty Steel, Inc., Pittsburgh, PA (US)

( * ) Notice: Subject to any disclaimer, the term of this patent is extended or adjusted under 35 U.S.C. 154(b) by 0 days.

(21) Appl. No.: 09/609,861

(22) Filed: Jul. 6, 2000

Related U.S. Application Data

(60) Provisional application No. 60/142,487, filed on Jul. 6, 1999.

(51) Int. Cl.[7] ..... B21B 39/20
(52) U.S. Cl. ..... 72/40; 72/252.5
(58) Field of Search ..... 72/40, 252.5

(56) References Cited

U.S. PATENT DOCUMENTS 2,116,107 * 3/1938 Erb ..... 72/252.5
5,799,527 * 9/1998 Kenmochi et al. ..... 72/252.5
5,830,291 11/1998 McGuire et al. ..... 148/610
6,230,534 * 5/2001 Sato et al. ..... 72/252.5

OTHER PUBLICATIONS

ASM handbook Committee, Metals Handbook, 1964, American Society of Metals, vol. 2, 8th edition, pp. 599–606 and 377–386.*

* cited by examiner

*Primary Examiner*—David Jones
(74) *Attorney, Agent, or Firm*—Webb Ziesenheim Logsdon Orkin & Hanson, P.C.

(57) ABSTRACT

A method for finishing cold-rolled stainless steel is disclosed, wherein the stainless steel is annealed and descaled. After descaling, the cold-rolled stainless steel is temper rolled, buffed and embossed. Line speed as fast as 75 fpm is used to produce an AISI #3 finish.

6 Claims, No Drawings

METHOD FOR FINISHING COLD-ROLLED STAINLESS STEEL

CROSS REFERENCE TO RELATED APPLICATIONS

This application claims priority of U.S. Provisional Application Ser. No. 60/142,487 filed Jul. 6, 1999, entitled "Method For Finishing Cold-Rolled Stainless Steel."

FIELD OF THE INVENTION

This invention relates to a method for imparting a finish onto cold-rolled stainless steel by partially buffing the steel coil and embossing the steel.

BACKGROUND OF THE RELATED ART

Methods for preparing finished stainless steel coil include casting a stainless steel slab, hot-rolling the slab to reduce its thickness, cold rolling the steel to further reduce the thickness of the slab and finishing the steel. The hot-rolling steps and the cold-rolling steps are followed by annealing steps, and, if the steel is annealed in an oxidizing atmosphere, a subsequent descaling step to remove oxidation product (scale) on the surface of the coil.

A variety of methods have been devised to impart a satisfactory finish onto the stainless steel. After cold rolling the steel, the coil must be annealed. The steel can be annealed in air, resulting in formation of an oxide layer on the steel, which must be removed prior to finishing the steel. The oxide may be removed by pickling in an acid solution, which typically yields a dull finish. The steel can be temper rolled to improve the finish and workability of the product. If desired, the steel can be abraded (polished) to a desired finish, such as an American Iron and Steel Institute (AISI) #3 finish. The steel also can be buffed to a mirror finish.

A second method for annealing cold-rolled stainless steel is to bright anneal the steel. In the bright annealing process, the steel is annealed in a non-oxidizing atmosphere, such as a hydrogen and/or a hydrogen/nitrogen atmosphere, to preclude formation of surface oxides. The benefit of bright annealing is that no pickling step is necessary, and the bright-annealed surface is brighter than the surface of air-annealed and pickled steel. The difficulty with bright annealing stainless steel is that facilities for bright annealing are rare and expensive.

A process used commercially to brighten stainless steel is to buff the steel. Buffing typically consists of rubbing a slurry of water and rouge (very fine abrasive particles) against the steel surface with fabric brushes. Buffing consists of a two-stage process, including a relatively rough cutting step and a color step which utilizes a finer abrasive. The buffing process produces a mirror finish but is time consuming and extremely expensive, costing 5–10 times as much as coarse abrasive polishing used to produce the standard brushed finish which is designated as "#3 polish" by AISI.

A further method for preparing bright stainless steel is disclosed in U.S. Pat. No. 5,830,291. In that patent, a bright surface is prepared by annealing the cold-rolled steel in air, but at temperatures lower than those typically used for annealing cold-rolled steel. This results in a layer of scale which can be removed by a molten salt treatment followed by a mild acid pickling step. The finish of the resultant steel is bright and is suitable for embossing with a desired finish or texture.

A desired finish pattern can be embossed on the surface of the steel. To emboss the surface of the steel, conventional wisdom dictates that the steel must have a finish of the type obtained in a bright anneal. The embossing is carried out through the use of specially ground rollers which impart a desired finish on the steel. For example, a standard AISI #3 finish can be embossed on bright steel.

It is therefore an object of the current invention to obtain a suitable surface on an air annealed and acid-pickled stainless steel sheet, regardless of thickness or grade, without the need for a bright anneal or otherwise polishing the product prior to shipment.

SUMMARY OF THE INVENTION

It has now been observed that temper rolling and buffing pickled (2D) steel at high line speeds to produce a surface condition duller than a bright or mirror finish provides a surface suitable for embossing. Finishing the steel in this manner results in a finish which is visually comparable to polished steel. Production costs are lowered due to the lesser costs associated with buffing according to the described method, rendering the production costs associated with the embossing process roughly equal to or better than costs associated with conventional procedures.

A method is described for finishing stainless steel, which includes the steps of temper rolling cold-rolled stainless steel which has been annealed and descaled; buffing the stainless steel at high line speeds (e.g., 50 fpm or greater) to impart a finish which is duller than bright annealed stainless steel; and embossing a finish onto the steel, preferably a finish which simulates a polished (brushed) finish.

The present invention also is directed to cold-rolled stainless steel which is finished according to the above-described method.

DETAILED DESCRIPTION OF THE PREFERRED EMBODIMENTS

Cold-rolled stainless steel is made by forming a hot mill band and cold reducing the hot mill band to form a full hard coil as disclosed in U.S. Pat. No. 5,830,291 to McGuire et al. which is herein incorporated by reference.

Conventional finishing lines for cold-rolled stainless steel include one or more cold-rolling steps followed by an annealing step to promote re-crystallization of the steel, thereby improving the workability of the steel. If the steel is annealed under non-oxidating conditions (bright annealed), the steel can be embossed directly to impart a desired finish on to the steel. If the steel is air annealed, scale must be removed prior to finishing. Typically, scale is removed by pickling, resulting in a dull finish. The dull pickled finish can be temper rolled and abraded (polished) to a suitable finish and/or buffed to a mirror finish. If the surface of the steel is to be embossed with a pattern, it was conventionally thought that the only suitable substrate was bright-annealed steel. However, it has now been found that a desired finish can be embossed onto a substrate which is temper rolled and buffed to a dull finish, short of a bright annealed finish, at line speeds up to (an possibly beyond) ten-fold those conventionally used to produce mirror finished steel. The steel will retain its bright finish after embossing, yet the efficiency of the finishing process is greatly improved by the high line speeds and by the elimination of the bright annealing step.

Traditional buffing lines have four to six buffing heads, half-cutting heads (for coarse buffing) and half color heads (for fine buffing). Table 1 shows typical buffing conditions for a T304 #2B coil ("standard setup"). Notably, the line speed is slow (8 feet per minute (fpm)). Under these standard buffing conditions, a bright surface is formed. As also shown in Table 1, the surface remained bright so long as a full complement of cutting heads were used and the speed of the line was low. When the line speed was raised to greater than 50 fpm and one of the cutting heads was removed (Trial 3), the surface of the steel remained dull, but the process yielded a surface suitable for embossing with an AISI #3 finish.

Typical buffing processes to produce a mirror finish cost 5–10 times as much as coarse abrasive sanding for producing a standard AISI #3 brushed finish. This renders traditional buffing to a mirror finish unsuitable for brightening steel for embossing. In the above-described experiments, steel was produced up to 837% faster than normal through a buffing line and still produced a substrate which, after embossing, was visually identical to the surface produced by embossing a bright-annealed substrate. Variations in the quality of the temper rolling step, the number of cut and color heads, the amount of abrasive (rouge) and line speed are expected to yield a variety of surfaces more or less suitable for imparting an AISI #3 finish by embossing. Similarly, variations in the temper rolling and buffing conditions may be more or less suited for embossing finishes other than a #3 finish onto the steel.

The above invention has been described with reference to the preferred embodiment. Obvious modifications and alterations will occur to others upon reading and understanding the preceding detailed description. It is intended that the invention be construed as including all such modifications and alterations insofar as they come within the scope of the described invention or the equivalents thereof.

TABLE 1

| Setup | Line Speed (fpm) | Buffing Heads* Cut | Buffing Heads* Color | Wheel Speed (fpm) | Buffing Compound | Comments |
|---|---|---|---|---|---|---|
| Standard | 8 | 2 | 2 | 3298 | standard quantity | bright finish, similar to bright annealed product |
| Trial 1 | 25 | 2 | 1 | 3298 | standard quantity | slightly duller, but still bright surface, some oscillation patterns |
| Trial 2 | 50 | 2 | 0 | 3298 | standard quantity | slightly duller, but still bright, no visible oscillation patterns |
| Trial 3 | 75 | 1 | 2 | 4214 | 3X standard quantity | dull surface with no oscillation marks |

We claim:

1. A method for finishing stainless steel comprising:

temper rolling cold-rolled stainless steel;

buffing the stainless steel to a predetermined surface quality which is less than the desired surface quality of the desired finished surface; and embossing a finish onto the stainless steel to the desired finished surface quality.

2. The method for finishing stainless steel of claim 1, wherein the stainless steel has been annealed and descaled prior to temper rolling.

3. The method for finishing stainless steel of claim 1 wherein, after embossing, the stainless steel has an AISI #3 finish.

4. The method for finishing stainless steel of claim 1 wherein the line speed for buffing the stainless steel is 25 to 75 fpm.

5. A method for producing stainless steel comprising:

forming a hot mill band;

cold reducing the hot mill band to form a full hard coil;

subjecting the full hard coil to a continuous anneal;

subjecting the annealed coil to a mild non-etching pickling process;

temper rolling the pickled coil;

buffing the surface of the tempered coil to a predetermined surface quality which is less than the desired surface quality of the desired finished surface; and embossing a finish onto the stainless steel to the desired finished surface quality.

6. The method for producing stainless steel of claim 5 wherein, after embossing, the stainless steel has an AISI #3 finish.

* * * * *